US005709055A

United States Patent [19]

Levi

[11] Patent Number: 5,709,055

[45] Date of Patent: Jan. 20, 1998

[54] WINDOW STRUCTURE

[76] Inventor: Jonathan Levi, 170 Rawson Rd., Brookline, Mass. 02146

[21] Appl. No.: 436,517

[22] Filed: May 8, 1995

[51] Int. Cl.[6] ..... E06B 1/04

[52] U.S. Cl. ..... 52/204; 52/204.593; 52/204.595; 52/204.597; 52/786.1; 52/786.13; 52/800.1

[58] Field of Search ..... 52/204.5, 204.593, 52/204.6, 786.1, 786.13, 800.11, 204.595, 204.597; 49/DIG. 1

[56] References Cited

U.S. PATENT DOCUMENTS

| | | | |
|---|---|---|---|
| 2,128,870 | 8/1938 | Woelfel | 52/786.1 X |
| 2,207,745 | 7/1940 | Lipsett | 52/204.595 X |
| 2,251,522 | 8/1941 | Nyberg | 52/204.597 |
| 2,286,890 | 6/1942 | Birt | 52/204.595 X |
| 3,919,023 | 11/1975 | Bowser et al. | 52/786.1 X |
| 3,971,178 | 7/1976 | Mazzoni et al. | 52/786.13 X |
| 4,296,587 | 10/1981 | Berdan | 52/786.1 |
| 4,454,703 | 6/1984 | Sitzler et al. | 52/786.13 X |
| 4,850,175 | 7/1989 | Berdan | 52/786.1 X |
| 5,156,894 | 10/1992 | Hood et al. | 52/786.13 X |
| 5,216,855 | 6/1993 | Richter et al. | 52/204.593 X |

*Primary Examiner*—Wynn E. Wood
*Attorney, Agent, or Firm*—Cesari and McKenna, LLP

[57] ABSTRACT

The present invention provides a window structure which is easily constructed and less expensive to produce than prior art window structures. The window structure includes a metallic sash having an L-shaped cross section which retains an insulated window lite containing a plurality of panes of glass. Glazing tape is placed on the portions of the L-shaped sash which are in plane with the panes of glass and the window lite is seated on one or more setting blocks located on the weight bearing structure of the sash. The window lite is securely mounted to the sash with a silicone adhesive which bonds the edges of the panes of glass to the sash. The silicone adhesive also acts as a thermal break to reduce heat transfer between exterior and interior sides of the window structure. The window structure of the present invention is elegantly simple in comparison to prior art structures since it takes advantage of the inherent rigidity of insulating window lite structures. In addition, the window structure of the present invention accommodates thicker window lite structures which increases the thermal efficiency of the window structure.

11 Claims, 5 Drawing Sheets

WINDOW STRUCTURE

DESCRIPTION

1. Technical Field

The present invention relates to window structures, and in particular to a simplified window structure with improved thermal performance, and a method of assembling the simplified window structure.

2. Background Of The Invention

Although the quality of construction materials and building techniques has increased considerably over the last fifty years or so, window designs have remained rather static. For example, window sashes which hold a window lite in place continue to remain primarily constructed of wood. A problem with these wooden structures is the many steps involved in manufacturing the sash. The steps include cutting the wood (e.g., ponderosa pine) and forming miter or tenon joints at the corners of the wood. The pieces are then joined to form the sash perimeter structure which holds the window lite in place. As a result of these numerous steps and the cost of wood, wooden window structures are relatively expensive. With reduced quantities of wood available, the price of windows promises to increase.

Non-residential buildings have used non-wooden sash structures (e.g., metallic), but these structures are also complex and relatively expensive to construct. Consider for example the window structure disclosed in U.S. Pat. No. 4,447,985 (hereinafter the '985 patent) assigned to Wausau Metals Corporation. That window structure is relatively complex as illustrated by the cross sectional views in FIGS. 2 and 3 of the '985 patent. In addition, due to the conductive thermal path of metal running from the exterior side 12 (FIG. 1 of the '985 patent) to the interior side 14 of the stationary casing 22, a heat transfer barrier 70 of polyethylene resin or a similar material having poor thermal conductive properties is required to act as a thermal break in order to achieve adequate thermal performance. The complexity of this prior art window structure leads to higher manufacturing costs.

Therefore, there is a need for a less expensive window structure and a method of producing the same.

SUMMARY OF THE INVENTION

An object of the present invention is to provide a window structure which is easily constructed and less expensive to produce.

Briefly, according to the present invention, a window structure includes a sash having an L-shaped cross section formed by a first sash member and a second sash member which retain an insulated window lite containing a plurality of panes of glass. Glazing tape is placed on an interior face of the first sash member, and the window lite is seated on two or more setting blocks located on the lower weight bearing portion of an interior face of the second sash member. The window lite is securely mounted to the sash with a silicone adhesive which bonds the edges of the panes of glass to the interior face of the second sash member. The silicone adhesive also acts as a thermal break to reduce heat transfer from the interior to the exterior sides of the window structure.

The sash may be formed from either a metallic material (e.g., eleven gauge steel or stainless steel) or rigid plastic. The sash also includes hinge pins along the top and bottom of the sash which allow the window structure to be opened and closed by rotating about the hinge pins. The hinge pins also allow the window structure to be quickly attached and detached from the window frame which retains the window structure.

The window structure of the present invention is elegantly simple in comparison to prior art structures since it takes advantage of the inherent rigidity of insulating window lite structures. This rigidity allows the window lite to be held in place in the sash by bonding the edges of the glass panels in the window lite to the sash using the silicone adhesive. Due to the rigidity of the window lite, the role of the sash in the present invention is primarily to provide a pivoting assembly within which the window lites rides, rather than providing a structural support for the window lite.

Although the primary advantage of the present invention is the relative ease with which the window structure of the present invention can be constructed, there are a number of other benefits. For example, since the window structure of the present invention does not include a thermally conductive path of metal from exterior to interior, a dedicated thermal break is not required. In addition, the window structure of the present invention is capable of using thicker window lites (e.g., 1⅛") in comparison to the prior art. This provides improved thermal performance for the window structure since the thicker the window lite, the more efficient the window is.

These and other objects, features and advantages of the present invention will become more apparent in light of the following detailed description of preferred embodiments thereof, as illustrated in the accompanying drawings.

DETAILED DESCRIPTION OF THE INVENTION

Figure 1:
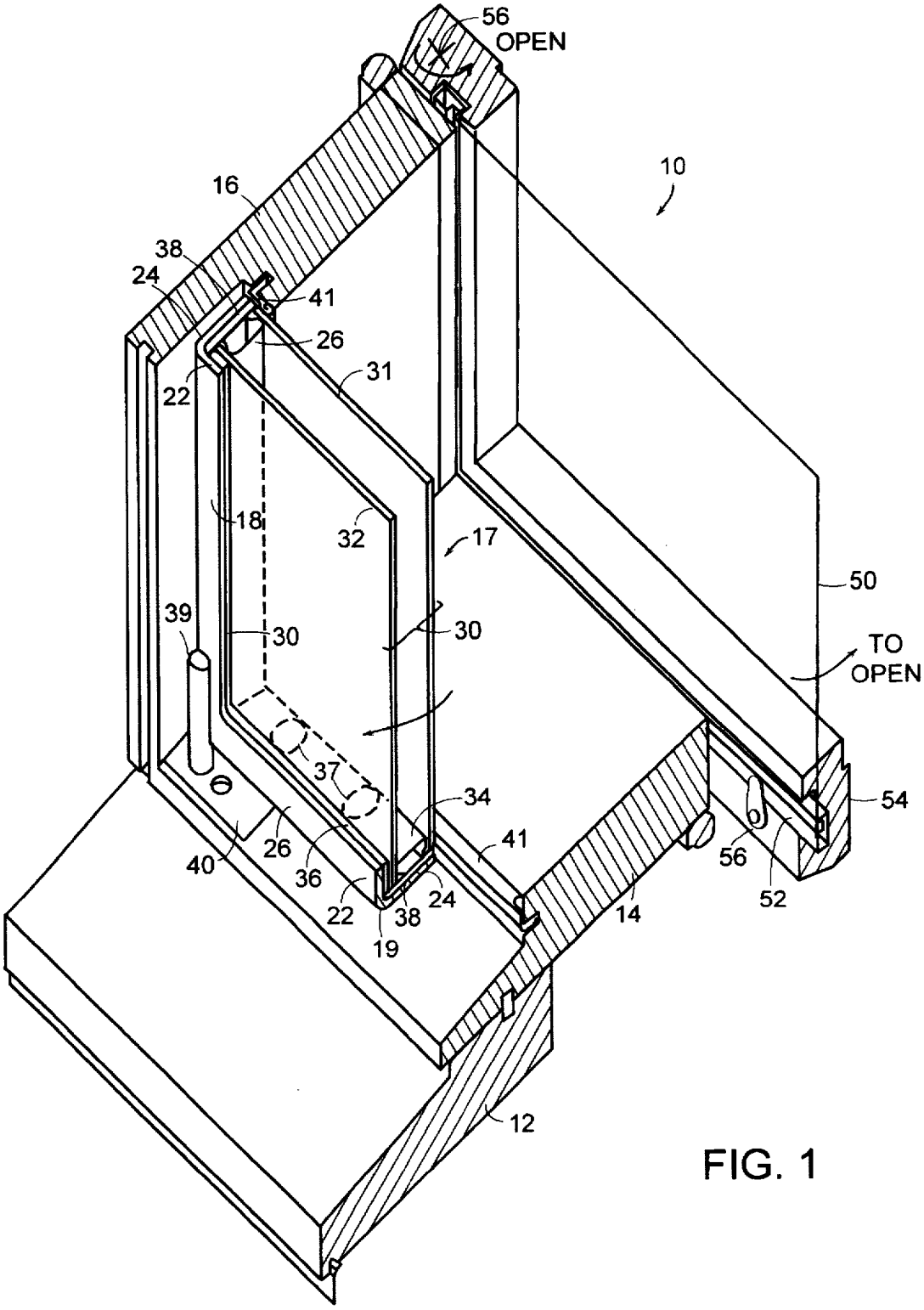
FIG. 1 illustrates a perspective view of a broken away portion of a window structure according to the present invention.

FIG. 1 illustrates a perspective view of a broken away portion of a rectangular window system 10 which includes a frame formed by a window subsill 12, a wooden sill 14, a plywood jamb 16, and a header plywood jamb (not shown). The window system also includes a window structure 17 which comprises a sash 18 having an L-shaped cross-section 19 (shown as cross-hatched), which defines the perimeter of the window structure and retains a window lite 30 in a novel manner according to the present invention.

Figure 2:
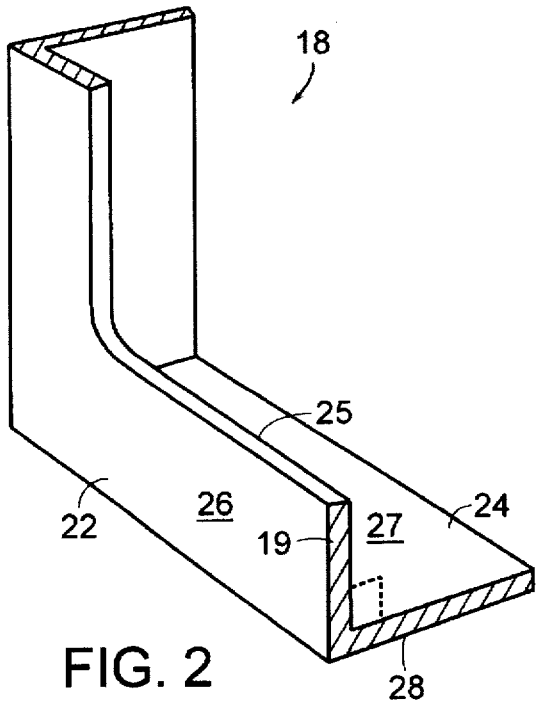
FIG. 2 illustrates the L-shaped cross-section of the sash.

FIG. 2 illustrates a perspective view of a portion of the sash 18. The L-shaped cross section 19 of the sash 18 is defined by a first member 22 and a second member 24 which are oriented at right angles to one another. The first member 22 includes an interior face 25 and an exterior face 26, while the second member 24 includes interior face 27 and exterior face 28.

Referring again FIG. 1, the window lite 30 includes two panes of glass 31, 32 which are separated by an anodized spacer 34. Window lites can generally be purchased as a single off-the-shelf component from manufacturers such as the American Flat Glass Company. To mount the window lite structure within the L-shaped sash 18, glazing tape 36 is placed around the interior face 25 (FIG. 2) of the first sash member 22. Setting blocks 37 are placed on the interior face 27 (FIG. 2) of the second sash member 24 (FIG. 2) to bear the weight of the window lite 30. To secure the window lite 30 to the sash 18, a silicone adhesive 38 is applied between the sash 18 and the edges of the glass panels 31,32 in the window lite 30. The window structure 17 is shown in the closed position such that the interior pane of glass 31 securely contacts a rubber gasket 41.

One of the features of the window structure 17 is that it accepts thicker window lites 30 using a much less complicated sash design. For example, it is contemplated that window lites 30 ranging in thickness from about ⅝" up to about 2" can be used in the sash. Window structures built according to the present invention have used window lites 30 having a thickness of 1⅛".

To facilitate opening and closing the window structure 17, the sash 18 includes a hinge pin assembly 39 located at the bottom of the sash and a hinge pin assembly (not shown) located at the top of the sash. Each hinge pin assembly includes a slideable member (not shown) which is seated and rotatably coupled to a socket formed in a hinge plate 40 when the window structure is securely mounted to the window frame. To facilitate easy installation and removal of the window structure 17, the slideable member of each hinge pin assembly 39 is easily manipulated to allow a user to either install or remove the window structure 17.

The window system 10 also includes an insect screen 50 mounted to a metal screen frame 52 which is held in a wooden screen sash 54 by a screen clip 56. To provide a user with access to the sash 18 in order to open and close the window, the wooden screen sash 54 also includes hinge pins (not shown) which allow the wooden screen sash to rotate about a point 56. The user simply opens the screen analogous to a door.

Figure 3:
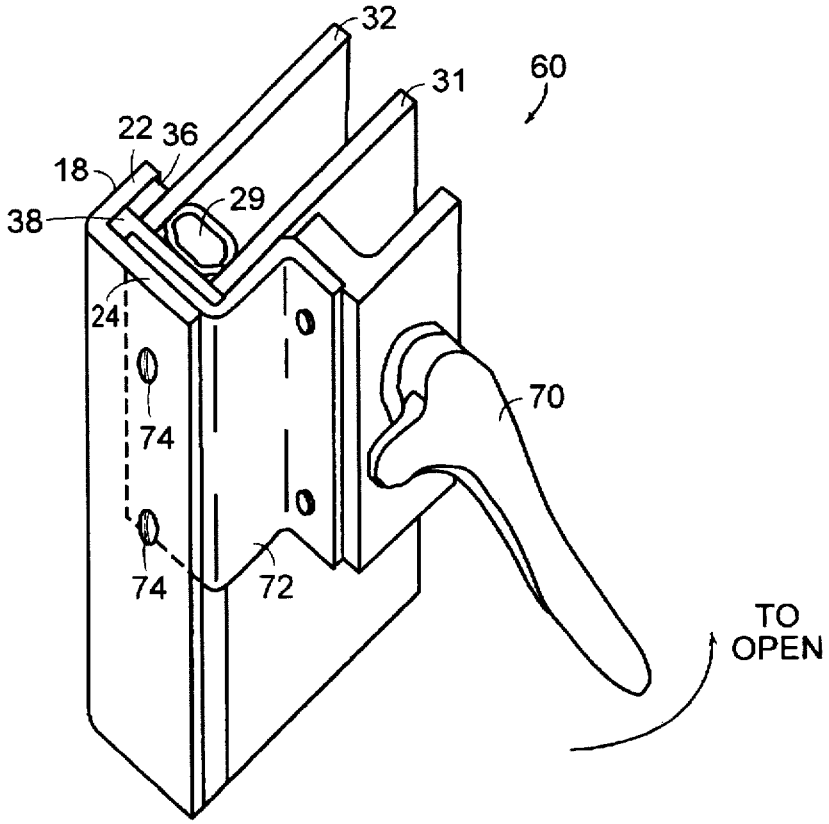
FIG. 3 illustrates a portion of the window structure including a latching mechanism which securely closes the window structure against the window frame.

FIG. 3 illustrates a portion 60 of the window structure 17 including a rotatable latching mechanism 70 mounted to the sash 18 to securely close the window structure 17 against the plywood jambs of the window frame. As shown, the latching mechanism 70 has a flanged hardware mounting bracket 72 which is securely mounted to the sash 18 by screw fasteners 74. To open the window, a user turns the latching mechanism in a counter-clockwise direction and then pushes outward. Similarly, to close and lock the window, the user pulls the handle of the latching mechanism inward, and then turns the handle in a clockwise direction. A unique feature of the present invention is that even for relatively large windows, only a single latching mechanism 70 is required to close the window and secure it to the window frame.

Figure 4A:
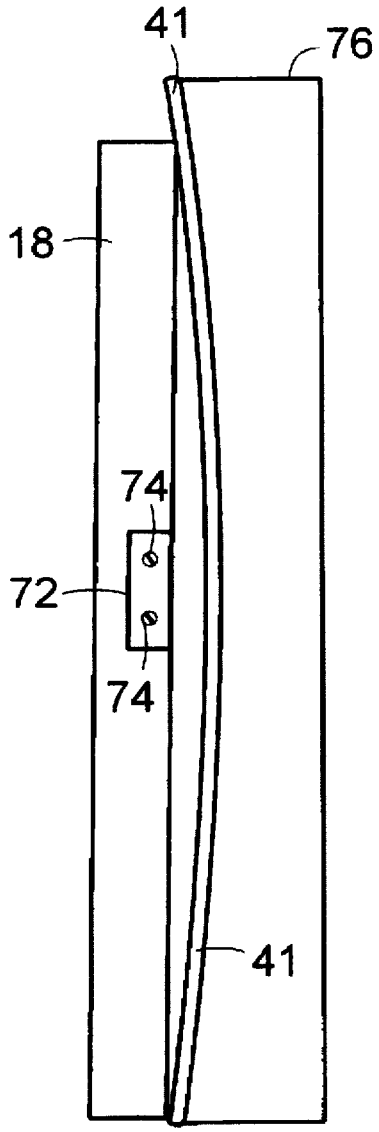
FIG. 4A illustrates a cross sectional view of the window structure placed against the concave shaped window jamb in the unlatched position.

Operation of the latching mechanism 70 may be better understood upon reference to FIG. 4A which illustrates a cross sectional view of the window structure 17 placed in the closed, but unlatched position against the gasket 41 of concave shaped plywood jamb 76. For ease of illustration in this cross-sectional view, the handle of the locking mechanism is not shown. In order to securely close the window using only a single latching mechanism 70, the plywood jamb 76 which contacts the side of the window structure having the latching mechanism (not shown in FIG. 1) is slightly concave. To lock the window structure closed against the plywood jamb 76, the user pulls the handle inward, and rotates the handle to lock the window.

Figure 4B:
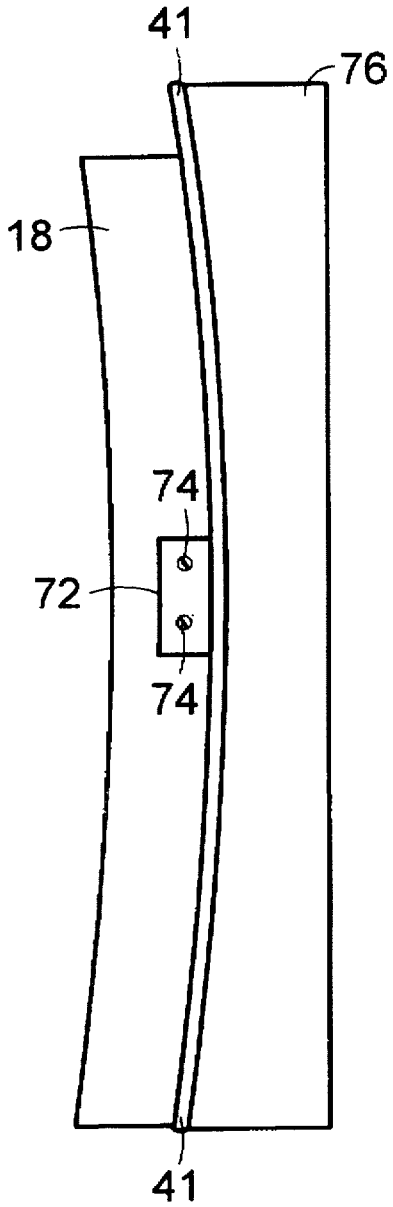
FIG. 4B illustrates the window structure latched in the closed position against the concave shaped window jamb.

The relationship of the sash 18 to the plywood jamb 76 is better understood with reference to FIG. 4B which illustrates the window structure 17 in the latched position against the gasket 41 mounted on the concave shaped window jamb 76. Upon inspection of FIG. 4B it is apparent that by pulling the handle of the latching mechanism 70 inward to latch the window closed, the sash becomes convex and the entire length of the sash is closed tightly against the gasket. Incidentally, it will be appreciated that glass and steel are materials which have "memory", and therefore, even if the window structure remains latched shut for a long period of time, once the window structure is unlatched the glass panes and the steel sash return to their planar orientation.

Figure 5:
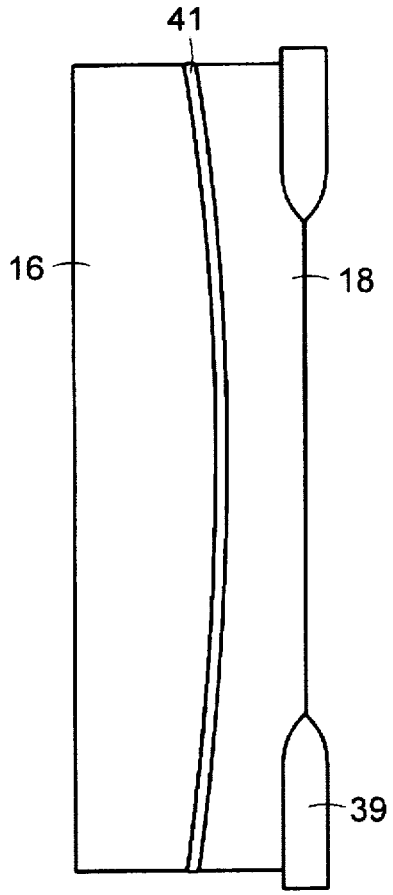
FIG. 5 illustrates a side view of the window structure 17 shown in FIG. 1 in tightly spaced relationship to the plywood jamb 16 when the window structure is latched shut.

Having observed the details of the concave shape of the plywood jamb on the side of the sash having the locking mechanism 70, attention may now be given to the plywood jamb 16 (as shown in FIG. 1) on the side of the hinge pin assembly 39. FIG. 5 illustrates the plywood jamb 16 having a slightly convex shape. The glass panel 31 (not shown) comes into flush contact with the gasket 41 along the entire height of the window when the window structure is latched shut. Note, analogous to the hinge pin assembly 39 at the bottom of the sash, the hinge pin assembly on the top of the sash mates with a socket in a hinge plate mounted in a header jamb (preferably formed of plywood) which runs horizontal to the top portion of the window frame.

Figure 6:
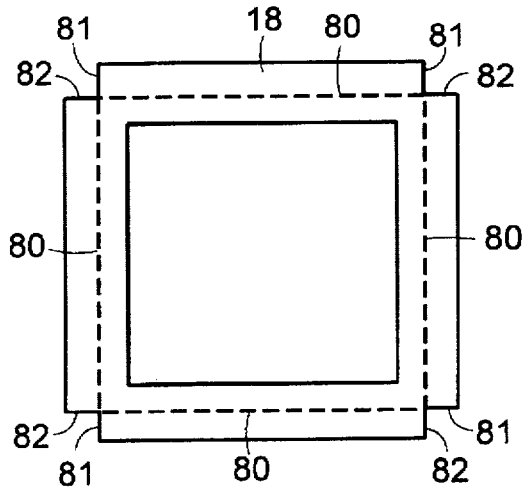
FIG. 6 illustrates a view of the unformed sash of the window structure shown in FIG. 1.

Having observed the details of the structure, attention may now be given to an example of the method of manufacturing the window structure 17. The sash 18 is cut from a single sheet of metallic material (e.g., eleven gauge steel) into a shape as shown in FIG. 6. The cut metallic piece is then bent 90° along dotted lines 80 to form the L-shaped cross section of the sash as shown in FIG. 1. Once bent into shape, adjacent edges 81, 82 of the sash 18 are joined together by welding or brazing to form the L-shaped cross section 19 shown in FIG. 1.

The sash is then galvanized or powder coated to increase the corrosion resistance of the eleven gauge steel. If an alternative material such as stainless steel is used for the sash, the corrosion step may not be required since the material may be inherently resistant to corrosion. The locking mechanism and the hinge pin assembly are then attached to the sash.

Figure 7:
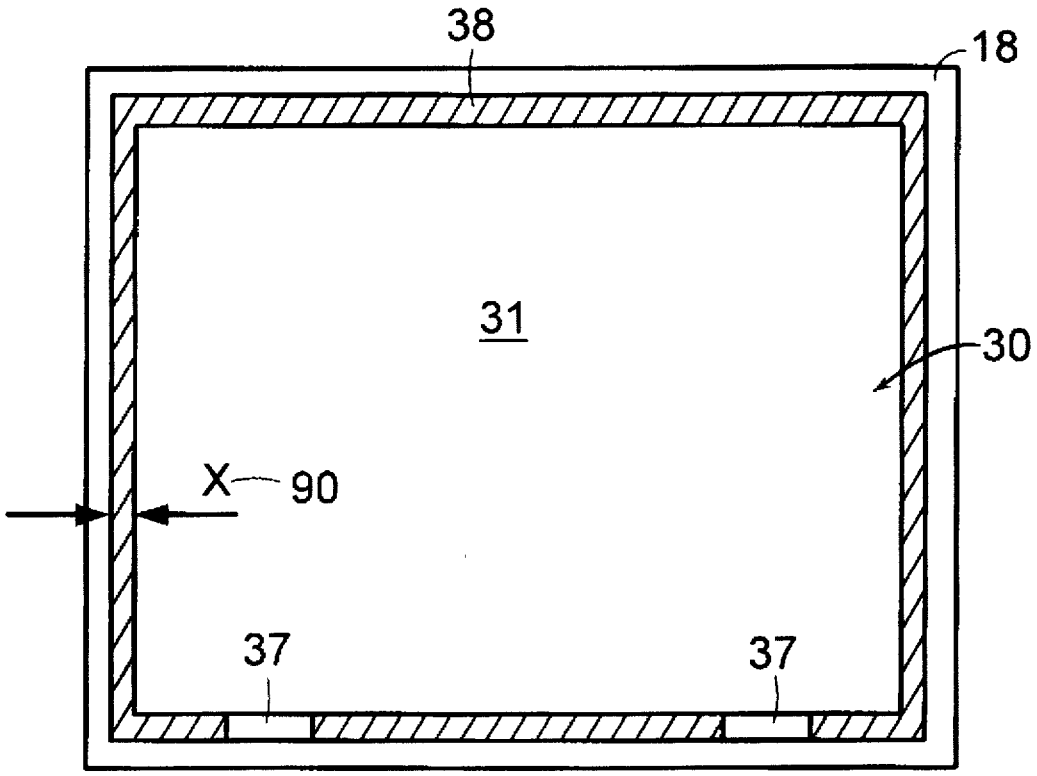
FIG. 7 illustrates a rear view of the window structure as seen by a viewer looking through the window structure from the interior side of the window structure.

The next step in the manufacturing process is to apply the glazing tape 36 (e.g., Butyl glazing tape) to the interior face 25 of the first sash member 22. The setting blocks 37 are then placed on the interior face 27 of the weight bearing portion of the sash 18 and the window lite is then laid into the sash. Referring to FIG. 7, the spacing×90 between the edges of the glass panes and the interior face 25 (FIG. 2) of the first sash member 22 should be on the order of one-eighth of an inch (⅛"). The silicone adhesive 38 is then deposited between the edges of the panes of glass and the sash to secure the window lite to the sash.

Of interest in the present invention is that a securing member is not required to prevent the window lite 30 from falling out of the sash 18. The present invention secures the glass lite to the sash by a bond between the edges of the glass panes 31, 32 and the sash. Although the bond is between the relatively thin edge of each of the panes 31,32 and the interior face 25 of the second sash member 24, the bond has been found to be quite secure against the shear forces required to cause the window lite to tear away and fall from the sash.

An additional feature of interest is that the unique metal sash window structure of the present invention and the manner in which the window structure closes, allows a relatively inexpensive piece of plywood to be used as the window jamb, rather than expensive solid wood (e.g., ponderosa pine) used in the prior art.

Not withstanding the foregoing description of an embodiment of the present invention, there are numerous other embodiments contemplated by the present invention. For example, although the present invention has been discussed in the context of a window lite having two panes of glass, it is contemplated that any insulating window lite may be used. In addition, although silicone has been discussed as the adhesive to bond the window lite to the sash, other adhesives may also be suitable for this application. Furthermore, rather than forming the sash from a single metallic piece, the sash 18 may be formed by joining (e.g., welding, brazing, etc . . . ) several different metallic pieces to form a sash having an L-shaped cross-section.

Although the present invention has been shown and described with respect to several preferred embodiments thereof, various changes, omissions and additions to the form and detail thereof, may be made therein, without departing from the spirit and scope of the invention.

What is claimed is:

1. A window structure comprising:

A. a rectangular sash having an exterior and interior side, and an L-shaped cross section formed by a first sash member having a first interior face and a second sash member having a second interior face, wherein said first and second sash members run along the entire perimeter of said sash, and said second member is formed at a right angle to said first member and has a width dimension which extends inward to said interior from said face of said first sash member;

B. glazing adhesive applied to an interior face of said first member;

C. a window lite seated in said sash, and comprising

C1. a first pane of glass having an exterior face and an interior face, and a perimeter edge, wherein said exterior face flushly contacts said glazing material, and said perimeter edges of said first pane are spaced from said second interior face;

C2. a spacer;

C3. a second pane of glass mounted in parallel to said first pane of glass and separated from said first pane by said spacer, wherein perimeter edges of said second pane are spaced a distance from said second interior face;

D. a sealant applied between said perimeter edges of said first and second panes and said face of said second sash member wherein, said glazing adhesive and said silicone sealant retain said window lite in said sash.

2. A method of assembling a window structure having an exterior side and an interior side, comprising the steps of:

forming a rectangular sash having an L-shaped cross section defined by a first sash member having an exterior face which faces the exterior side and an interior face which faces the interior side, a second sash member having an interior face which is perpendicular to said interior face of said first sash member, and has a width dimension which runs from said interior face of said first sash member towards the interior side of the window structure;

applying glazing tape to said interior face of said first sash member;

seating a window lite including a plurality of glass panes each having edges which run about the perimeter of the window lite; and applying a silicone sealant between said edges of said window lite and said interior face of said second sash member, wherein said window lite is held in place by a bond between said edges of said window lite and said interior face of said second sash member.

3. A window system, comprising:

A) a window frame which includes a sill and a rectangular jamb, said jamb comprising horizontal and vertical jamb members;

B) a window structure which is detachably mounted in said window frame comprising 1) a rectangular sash having an exterior side and an interior side, and an L-shaped cross section formed by a first sash member having a first sash interior face and a second sash member having a second sash interior face, wherein said first and second sash members run along the perimeter of said sash, and said second sash member is formed at a right angle to said first sash member and has a width dimension which extends inward to said interior side from said first sash interior face;

2) a glazing adhesive applied to an interior face of said first sash member;

3) a window lite seated in said sash, and comprising a first pane of glass having an exterior face and an interior face, and a perimeter edge, wherein said exterior face flushly contacts said glazing adhesive, and said perimeter edge is spaced a distance from said second sash member interior face;

a spacer;

a second pane of glass having an exterior face and mounted in parallel to said first pane of glass, separated from said first pane by said spacer, and having a second pane perimeter edge spaced a distance from said second sash member interior face;

4) a sealant applied between said perimeter edges of said first and second panes and said second sash member interior face to hold said window lite in said sash;

5) first and second hinge pin assemblies affixed to one of said vertical jamb members such that said window structure rotatably opens and closes; and 6) a rotatable latching mechanism mounted to another of said vertical jamb members, for closing and locking said window structure against said frame;

wherein said vertical jamb members include a slightly concave surface against which a portion of said exterior face of said second pane of glass flushly contacts when said rotatable latching mechanism locks said window in place, such that vertical portions of said sash and said second pane of glass become slightly convex shaped in order to flushly contact said slightly concave surface.

4. The window system of claim 3, further comprising a rubber gasket mounted on said horizontal and vertical jambs, such that when said window structure is closed said rubber gasket is located between second pane of glass and said horizontal and vertical jambs.

5. The window system of claim 4, wherein said window frame is constructed of wood.

6. The window system of claim 4, wherein said sash is metallic.

7. The window system of claim 4, wherein said sash is rigid plastic.

8. The window system of claim 4, wherein said adhesive is a silicone adhesive which reduces the heat transfer between the exterior and interior sides of said window structure.

9. The window system of claim 4, further comprising an insect screen rotatably mounted to said rectangular jamb on the interior side of said window structure.

10. A window system, comprising:

A) a window frame which includes a sill and a rectangular jamb, said jamb comprising horizontal and vertical jamb members;

B) a window structure which is detachably mounted in said window frame comprising 1) a rectangular sash having an exterior side and an interior side, and an L-shaped cross section formed by a first sash member having a first sash interior face and a second sash member having a second sash interior face, wherein said first and second sash members run along the perimeter of said sash, and said second sash member is formed at a right angle to said first sash member and has a width dimension which extends inward to said interior side from said first sash interior face;

2) a glazing adhesive applied to an interior face of said first sash member;

3) a dual pane window lite seated in said sash, and having an exterior face, an interior face, and a perimeter edge, wherein said exterior face flushly contacts said glazing adhesive, and said perimeter edge is spaced a distance from said second sash member interior face;

4) a sealant applied between said perimeter edges of said window lite and said second sash member interior face;

5) first and second hinge pin assemblies affixed to one of said vertical jamb members such that said window structure rotatably opens and closes; and 6) a rotatable latching mechanism mounted to another of said vertical jamb members, for closing and locking said window structure against said frame, wherein said vertical jamb members include a slightly concave surface against which a portion of said exterior face of said second pane of glass flushly contacts when said rotatable latching mechanism locks said window in place, such that vertical portions of said sash and said second pane of glass become slightly convex shaped in order to flushly contact said slightly concave surface.

11. The window structure of claim 1, wherein said window structure pivotably mounts to a window frame having a concave shaped vertically oriented jamb, said window structure further comprising:

E. first and second hinge pin assemblies affixed to said sash such that said window structure pivotably opens and closes; and F. a rotatable latching mechanism mounted on said sash for closing and locking said sash against said concave shaped jamb, wherein said window structure closes against the concave shaped jamb.

* * * * *